United States Patent [19]

Szkaradek

[11] 4,140,283

[45] Feb. 20, 1979

[54] SANDMILL VESSEL WITH INLET DIFFUSER AND REMOVEABLE OUTLET FILTER

[75] Inventor: Edward J. Szkaradek, Santa Ana, Calif.

[73] Assignee: Morehouse Industries, Inc., Fullerton, Calif.

[21] Appl. No.: 851,076

[22] Filed: Nov. 14, 1977

[51] Int. Cl.[2] ..... B02C 23/00

[52] U.S. Cl. ..... 241/46.11; 241/21; 241/74; 241/46.17

[58] Field of Search ..... 241/46.02, 46.11, 46.17, 241/74, 171, 172; 209/305, 370, 372, 373, 391, 406, 407, 319, 363, 364; 366/150, 184

[56] References Cited

U.S. PATENT DOCUMENTS

| | | | |
|---|---|---|---|
| 3,134,549 | 5/1964 | Quackenbush et al. | 241/74 |
| 3,135,474 | 6/1964 | Schold | 241/21 |
| 3,172,609 | 3/1965 | Olsen et al. | 241/74 |
| 3,352,500 | 11/1967 | Molls et al. | 241/74 |

*Primary Examiner*—Robert L. Spicer, Jr.
*Attorney, Agent, or Firm*—Knobbe, Martens, Olson, Hubbard & Bear

[57] ABSTRACT

The liquid processing vessel in a sandmill is provided with a perforated annular member near the liquid inlet for evenly distributing the liquid to be processed around the rotor. The upper portion of the vessel from which the processed liquid is discharged is provided with a split filter screen and a split filter screen cover which may be quickly and easily detached and removed from the vessel without the need for removing the entire vessel from its support structure.

25 Claims, 4 Drawing Figures

FIG. 1.
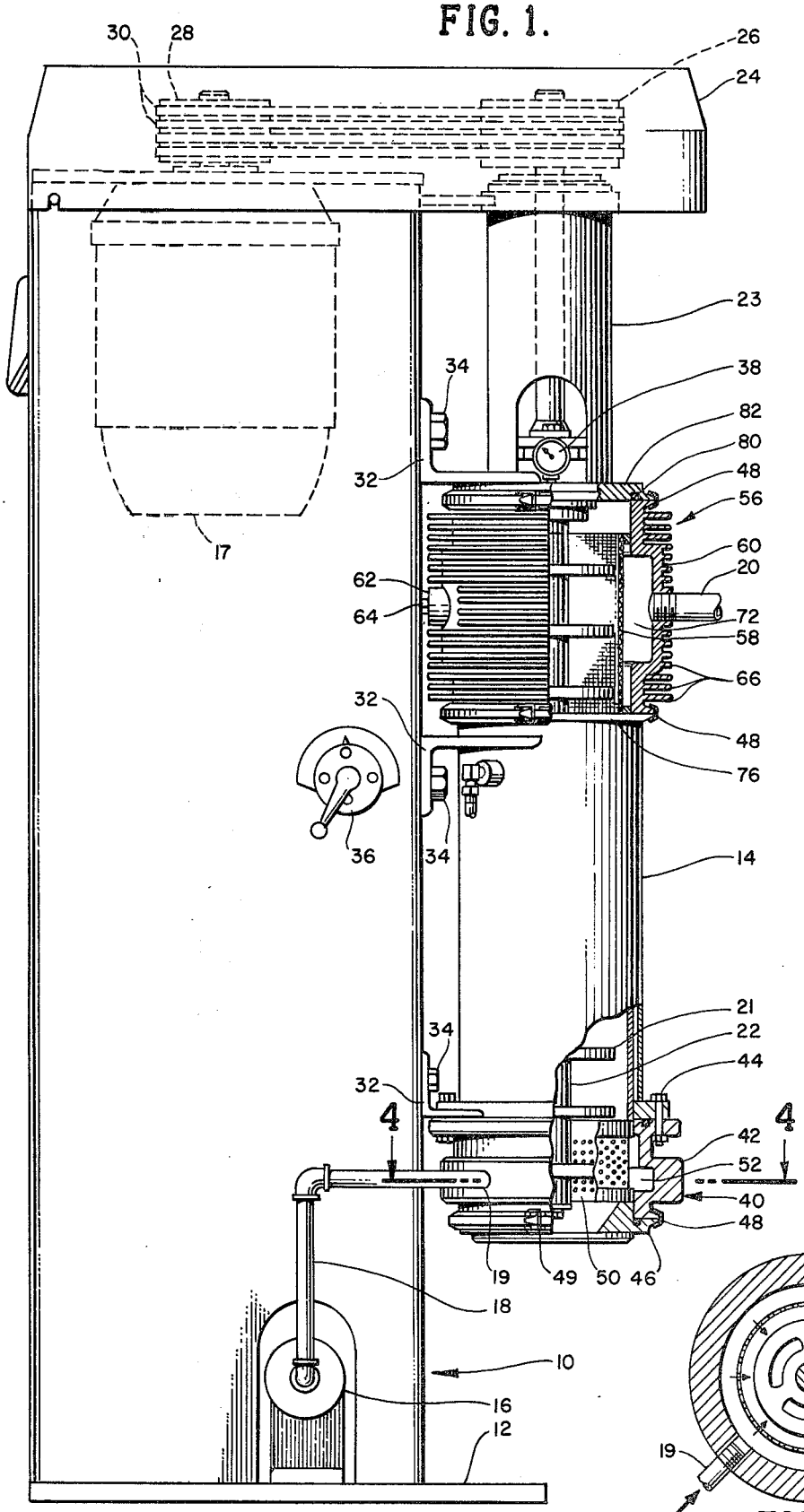
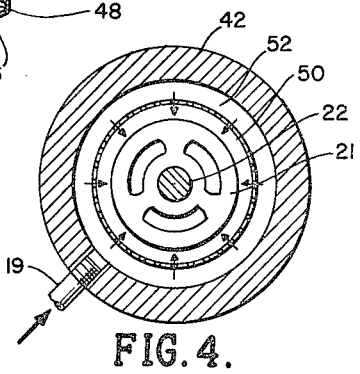
FIG. 4.

SANDMILL VESSEL WITH INLET DIFFUSER AND REMOVEABLE OUTLET FILTER

BACKGROUND OF THE INVENTION

This invention relates to a new type of construction for the liquid processing vessel in a sandmill. More specifically, the invention relates to an improved arrangement for dispersing the liquid introduced into the sandmill and to an improved arrangement for mounting filter screen at the output end of a sandmill vessel.

Sandmilling is a proven, practical, continuous, high production method of dispersing and milling particles in liquids to produce smooth, uniform, finely dispersed products. One good example of this is the dispersement of pigment agglomerates in paints. The process is also applicable to a wide variety of inks, dye stuffs, paper coatings, chemicals, magnetic tape coatings, insecticides and other materials where milling to a high degree of fineness is required.

In a typical sandmilling process, the material or slurry to be processed is introduced at the bottom of a processing chamber and pumped upwardly through grinding media, which is often referred to as sand, although it is normally a small diameter manufactured grit rather than sand. Rotors positioned within the vessel forming the processing chamber grind the slurry as it is pumped through the media.

Usually the sandmill vessel is cylindrically shaped and is mounted on a support column with the rotor axis extending vertically parallel to the column. The motor to drive the rotor is normally mounted in the upper portion of the support column and belts are utilized to transmit the rotational force of the motor to a pulley attached to the upper end of the drive shaft that extends downwardly into the vessel where it is attached to the rotor.

One problem associated with the typical sandmill is that the liquid or slurry introduced to the bottom of the vessel, being of a relatively thick consistency, tends to concentrate at the point of introduction and therefore often fails to disperse evenly around the rotors.

Typically the processed slurry or liquid exits the vessel at its upper terminus. Since the liquid may contain suspended particles of the grinding media, it is found to be advantageous to incorporate a filtering screen at the vessel's outlet. Typically, such a filtering screen is an annular member attached to the upper portion of the vessel. A typical arrangement for the filtering screen is disclosed in U.S. Pat. No. 3,135,474 to Schold. One problem with such an arrangement results from the necessity for frequently removing the screen for cleaning and maintenance. With an arrangement such as that disclosed in the Schold patent it is necessary to remove the entire vessel from its support structure, a process which is both time consuming and inconvenient.

Hence, a need has been felt for providing a sandmill vessel which incorporates a means for dispersing the slurry or liquid to be processed at the inlet end and which also provides a filter screen that is quickly and easily detached from the unit without the necessity for removing the entire vessel.

SUMMARY OF THE INVENTION

The present invention overcomes the aforementioned problems by providing a sandmill vessel having means for diffusing the incoming liquid around the periphery of the rotor and which also incorporates a filter screen arrangement at the outlet of the vessel which is easily detached therefrom without the necessity for removing the vessel from the support structure.

The diffusing means incorporated in the vessel consists of a perforated annular member which surrounds the lower portion of the agitating rotor inside the vessel. The liquid to be processed is injected into an annular channel surrounding the diffusing member. The channel distributes the liquid around the entire circumference of the diffusion member and the liquid then flows through the perforations in the diffusing member into the area containing the rotor and the grinding media. In this manner the liquid is more evenly distributed throughout the grinding media, thereby providing a more uniform product and avoiding the problem of undue concentration of the liquid at a point near the inlet.

As the liquid is processed by the rotor and the grinding media, it passes upwardly through the vessel until it reaches the uppermost portion of the vessel from which it is discharged through an outlet. The upper portion of the vessel is provided with an annular or cylindrical filter screen surrounding the rotor near the outlet. The screen serves to ensure that the liquid leaving the vessel is free of particles of grinding media. In the present invention this screen is divided axially into two separate adjoining halves. In the preferred embodiment of the invention, a screen housing or cover is provided which has an outlet orifice. The cover is split into halves corresponding to the halves of the screen. The cover halves are secured tightly to each other and to the top of the vessel by means of circular clamps. When so secured the cover holds the screen halves together by abutting tightly against flanges provided at the top and bottom of the screen halves. Thus, by simply removing the circular clamps, the entire screen and screen cover assembly can be quickly and conveniently removed from the vessel so that the screen may be quickly replaced with a clean screen.

In an alternative embodiment of the invention a similar arrangement is used with the exception that the screen cover extends only part way up along the sides of the screen leaving a substantial portion of the screen surface exposed.

DESCRIPTION OF THE DRAWINGS

FIG. 1 is a side elevation view, partially broken away, of a sandmill having a vessel which incorporates the present invention;

FIG. 4 is a cross-sectional view on line 4—4 of FIG. 1.

DETAILED DESCRIPTION OF THE INVENTION

Figure 3:
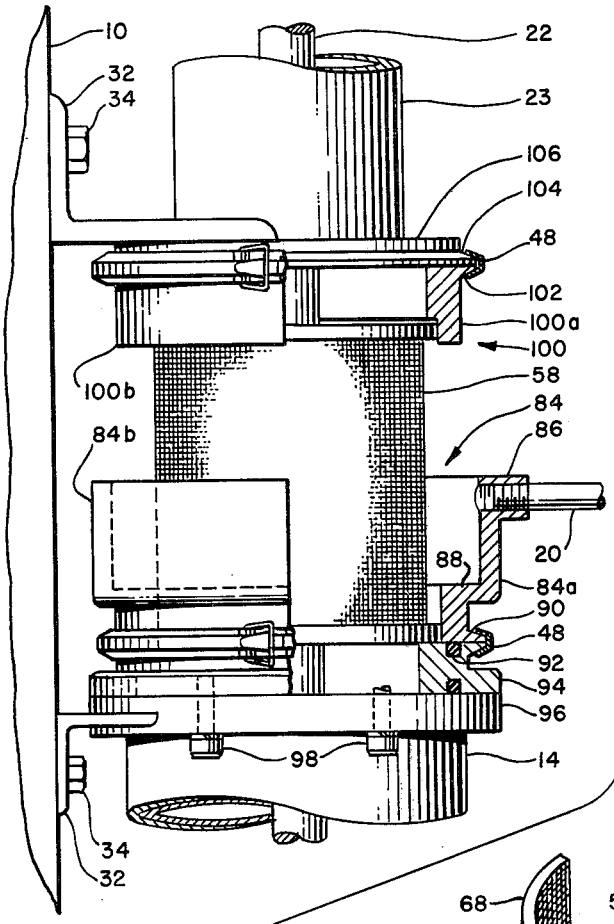
FIG. 3 is a side elevation view, partially broken away, of an alternative embodiment of the screen and screen cover assembly of the invention.

Referring to FIG. 1, the sandmill apparatus shown includes a support column or pedestal 10 mounted on a platform or base 12. The column has a rectangular cross-section and is made of heavy metal plate to support the weight of a cylindrical vessel 14 which is vertically oriented and mounted on the support column 10. Liquid to be processed through the vessel 14 is moved by a pump 16 supported on the column 10 and driven by a motor 17 positioned within the column. The output from the pump 16 is ducted by a pipe 18 to an inlet 19 in the lower end of the vessel 14 and pumped upwardly through the vessel and out of an outlet pipe 20 on the upper end of the vessel.

Within the vessel 14 there is a plurality of rotors 21 mounted on a drive shaft 22 which extends out the upper end of the vessel through a tubular housing 23 and into a transmission housing 24 mounted on the upper end of the support column 10. A drive pulley 26 is mounted on the upper end of the shaft 22 and a driving pulley 28 is mounted on the upper end of the motor 17. A plurality of belts 30 transmits the driving force from the pulley 28 to the pulley 26.

Several right-angle brackets 32 are welded to the vessel 14 and the brackets 32 are in turn secured to the column 10 by suitable means such as bolts 34.

While the material to be processed by the sandmill is being pumped upwardly through the vessel, the rotors within the vessel are rotated by the drive means as described. The rotors agitate a grinding media, usually referred to as sand, although it is typically a manufactured grit. The combination of the moving grit plus the fluid being pumped through the medium mills or grinds particles within the liquid so that the resulting product is very fine and well fixed. The operation of the sandmill is regulated by a pump speed control indicator 36 mounted on the column 10 and by a pressure gage 38 which is viewable through an aperture in the housing 23.

As explained above, it is advantageous to provide a means for achieving a wide dispersion of the liquid at the inlet of the vessel. To this end, a diffuser assembly 40 is provided at the lower end of the vessel 14. This assembly consists of a diffuser housing 42 attached to the lower end of the vessel 14 as by a plurality of bolts 44. The bottom of the assembly is closed by means of an end plate 46 which is secured to the housing 42 by means of a circular retaining ring 48 having a quick-release catch 49. A perforated annular diffuser screen 50 is provided within the housing 42 and is maintained in position by abutment against the interior wall of the housing 42 and the end plate 46. The interior of the housing 42 is shaped so as to provide a channel 52 surrounding the diffuser screen 50 and it is into this channel that the liquid is introduced via the inlet 19. The end plate 46 may be removed by removing the retaining ring 48, thereby permitting the diffuser screen to be quickly and conveniently removed for maintenance purposes.

The product flow may be more easily visualized from FIG. 4, wherein it is shown by the arrows 53 that the product is circulated around the channel 52 and through the holes in the diffuser 50. This arrangement assures that the product is uniformly distributed around the lower end of the rotor, which, in turn, provides uniform mixing and residence time of the product in the vessel. Stated otherwise, the diffuser minimizes the possibility of laminar flow up through the vessel, and instead promotes more thorough mixing.

The diffuser screen 50 also prevents media from flowing backward into the channel 52 and to the pump 16, when the pumping is interrupted. Media in the pump could, of course, damage it.

Figure 2:
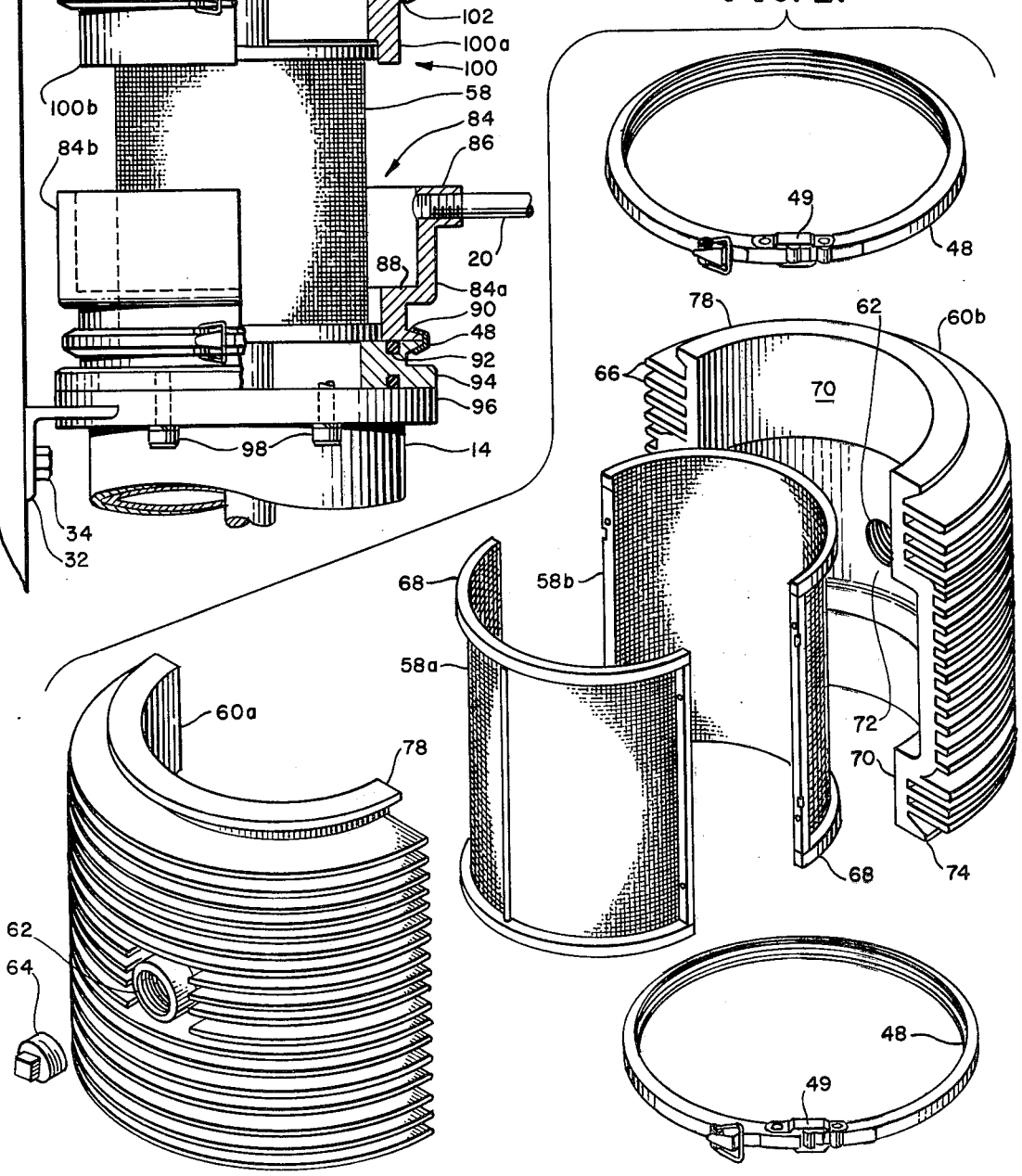
FIG. 2 is an exploded perspective view of the screen and screen cover assembly of the preferred embodiment of the invention.

In the preferred embodiment shown in FIGS. 1 and 2, a fully enclosed outlet assembly 56 is attached to the upper end of the vessel 14. This assembly consists of a tubular filter screen 58 surrounding several of the upper-most rotors 21 and a tubular filter screen cover 60 surrounding and enclosing the filter screen 58. As shown in FIG. 2, the filter screen 58 is axially divided into two identical adjoining halves, **58*a* and 58*b*. The cover 60 is likewise divided into identical adjoining halves 60*a* and 60*b*, each of which contains a central threaded aperture 62. In the cover half 60*a*, the aperture is sealed with a threaded plug 64 while in the cover half 60*b*, the aperture 62 is fitted with the outlet pipe 20. The cover 60 may be conveniently provided with air-cooling fins 66**.

The upper and lower ends of the filter screen 58 are provided with terminal rings 68 which seat against inwardly extending projections 70 along the inner wall of the cover 60. The inner wall of the cover 60 is also provided with a relatively wide central groove 72 which provides a circumferential channel around the filter screen 58.

The lower end of the screen cover 60 is provided with a flange 74 which seats against a corresponding flange 76 around the upper periphery of the vessel 14. The screen cover halves **60*a* and 60*b* are secured to each other and to the vessel 14 by means of a circular retaining ring 48, identical to the retaining ring used in the diffuser assembly 40, which surrounds the flanges 74 and 76. The upper end of the filter cover 60 is provided with a flange 78 which seats against a corresponding flange 80 around the periphery of a circular support member 82. Another of the circular retaining rings 48 surrounds the flanges 78 and 80 to secure the upper ends of the cover halves 60*a* and 60*b* to each other and to the support member 82. The support member 82 is in turn welded to one of the angled brackets 32 which is secured to the support column 10 with bolts 34**.

The aforementioned construction of the outlet assembly 56 permits the quick and easy disassembly and removal of the screen cover 60 and the filter screen 58 by simply removing the retaining rings 48. As may be readily appreciated, this procedure can be performed without the necessity for removing the entire vessel 14 from the support column 10, thereby saving a great deal of time and expense in the maintenance of the apparatus while adding greatly to the safety of maintenance.

An alternative embodiment of the outlet assembly depicted in FIG. 3 differs from the preferred embodiment primarily in that only the lower portion of the filter screen 58 is covered.

In this configuration the filter screen 58 is identical to that used in the preferred embodiment. A cover 84 circumferentially surrounds approximately the lower half of the screen 58. This cover 84 is axially divided into a front half **84*a* and a rear half 84*b*. The front cover half 84*a* is provided with an apertured neck 86 adjacent its upper periphery and into the neck 86 is fitted the outlet pipe 20. The inner wall of the cover 84 has a radially inwardly extending projection 88 around the lower portion thereof which engages the lower terminal ring 68 of the filter screen 58. A flange 90 surrounds the bottom periphery of the cover 84 and seats against a corresponding flange 92 around the upper periphery of an adaptor ring 94. A circular retaining ring 48 engages the flanges 90 and 92 to secure the cover halves 84*a* and 84*b* to each other and to the adaptor ring 94. The adaptor ring 94 is secured to a flange 96 surrounding the upper periphery of the vessel 94 by means such as bolts 98**.

The upper terminal ring 68 of the filter screen 58 is seatingly engaged by the inner wall of an upper annular support member 100 which is axially divided into two identical halves, 100*a* and 100*b*. The upper periphery of the upper support member 100 terminates in an outwardly extending flange 102 which seats against a corresponding outwardly extending flange 104 which surrounds the periphery of an upper annular terminal plate 106. A circular retaining ring 48 engages the flanges 102 and 104 to secure the upper support member halves 100*a* and 100*b* to each other and to the upper support plate 106. Angled brackets 32 are welded to the upper support plate 106 and to the vessel flange 96, and the angled brackets 32 are in turn secured to the support column 10 by means of bolts 34.

The outlet assembly in the alternative embodiment may be disassembled by simply removing the two retaining rings 48 thereby offering the same advantages of quick and convenient assembly and disassembly as are offered by the preferred embodiment.

What is claimed is:

1. An improved apparatus for grinding or processing a liquid of the type having a vertical vessel for receiving grinding media and a liquid to be processed, a motor-driven rotor in said vessel for agitating said grinding media and said liquid, a liquid inlet at the bottom of said vessel, and a liquid outlet at the top of said vessel, wherein the improvement comprises:

diffusing means inside said vessel between said inlet and said rotor, for diffusing said liquid around the periphery of said rotor;

a tubular filter screen coaxial with said rotor and proximate said outlet, said filter screen being axially divided into adjoining arcuate segments;

a cover surrounding said filter screen, said cover being axially divided into adjoining arcuate segments which maintain the adjoinment of said screen segments; and retaining means for maintaining the adjoinment of said cover segments.

2. An improved apparatus for grinding or processing a liquid, as defined in claim 1, wherein each of said cover segments conforms to one of said screen segments, and said cover is in fluid communication with said outlet.

3. An improved apparatus for grinding or processing a liquid, as defined in claim 1, wherein said cover surrounds only the lower portion of said filter screen.

4. An improved apparatus for grinding or processing a liquid, as defined in claim 1, wherein said diffusing means is a perforated member mounted coaxially with said rotor.

5. An improved apparatus for grinding or processing a liquid, as defined in claim 1, wherein said filter screen is divided into two arcuate screen segments, each of which extends approximately 180°.

6. An improved apparatus for grinding or processing a liquid, as defined in claim 1, wherein said retaining means is a circular surrounding said cover.

7. An improved apparatus for grinding or processing a liquid, of the type having a vertical vessel for receiving grinding media and liquid to be processed, a motor-driven rotor in said vessel for agitating said grinding media and said liquid, a liquid inlet at the bottom of said vessel, and a liquid outlet at the top of said vessel, wherein the improvement comprises:

diffusing means inside said vessel between said inlet and said rotor for diffusing said liquid around the periphery of said rotor.

8. An improved apparatus for grinding or processing a liquid, as defined in claim 7, wherein said diffusing means is a perforated member mounted coaxially with said rotor.

9. An improved apparatus for grinding or processing a liquid, as defined in claim 7, wherein said perforated member is annular.

10. An improved apparatus for grinding or processing a liquid, of the type having a vertical vessel for receiving grinding media and a liquid to be processed, a motor-driven rotor in said vessel for agitating said grinding media and said liquid, a liquid inlet at the bottom of said vessel, and a liquid outlet at the top of said vessel, wherein the improvement comprises:

a tubular filter screen coaxial with said rotor and proximate said outlet, said filter screen being axially divided into two unattached adjoining arcuate screen segments;

a substantially solid, open-ended tubular cover surrounding said filter screen, said cover being axially divided into two adjoining arcuate cover segments and including inwardly extending means abutting against said screen segments for maintaining the adjoinment of said screen segments; and retaining means for maintaining a sealing adjoinment between said cover segments and for maintaining the abutment between said inwardly extending means and said screen segments.

11. An improved apparatus for grinding or processing a liquid, as defined in claim 10, wherein each of said cover segments conforms to one of said screen segments, and said cover is in fluid communication with said outlet.

12. An improved apparatus for grinding or processing a liquid, as defined in claim 10, wherein said cover surrounds only the lower portion of said filter screen.

13. An improved apparatus for grinding or processing a liquid, as defined in claim 10, wherein said filter screen is divided into two arcuate screen segments, each of which extends approximately 180°.

14. An improved apparatus for grinding or processing a liquid, as defined in claim 10, wherein said retaining means is a circular clamp surrounding said cover.

15. An apparatus for grinding or processing a liquid, comprising:

a support structure;

rotor means for agitating a grinding media and a liquid to be processed;

vertically oriented container means coaxial with said rotor means and attached to the side of said support structure for receiving said grinding media and said liquid to be processed, said container means having a lower inlet section, a central processing section, and an upper outlet section, said outlet section being detachably mounted to said processing section, said outlet section comprising:

a tubular filter screen vertically divided into two separable unattached adjoining screen halves;

a substantially solid, open-ended, tubular cover surrounding said filter screen, said cover being vertically divided into two separable adjoining cover halves;

means extending inwardly from the interior of said cover halves for abutting against said screen halves; and retaining means for detachably mounting said cover to said processing section and for maintaining both the adjoinment of said cover halves and the abutment between said inwardly extending means and said screen halves so that the adjoinment of said screen halves is maintained, said filter screen halves and said cover halves being removable from each other and from said processing section by the removal of said retaining means.

16. The apparatus of claim 15, wherein the lower end of said cover and the upper end of said central section have adjoining flanges.

17. The apparatus of claim 16 wherein said retaining means surrounds said flanges.

18. The apparatus of claim 17 wherein said retaining means is a circular clamp.

19. An apparatus for grinding or processing a liquid, comprising:

a support structure;

vertically oriented container means attached to the side of said support structure for receiving grinding media and a liquid to be processed, said container means having a fluid inlet near the bottom thereof;

motor-driven rotor means in said container means for agitating said grinding media and said liquid; and diffusing means coaxial with said rotor means inside said container means proximate said inlet for diffusing said liquid around the periphery of said rotor means.

20. The apparatus of claim 19 wherein said diffusing means is a perforated annular member.

21. Apparatus comprising:

a support;

a container adjacent said support for receiving grinding media and liquid to be processed through said container, said container including a lower end having a liquid inlet, a central processing section, an upper end, and an outlet section between the upper end and said central section and having a liquid outlet;

mounting means connecting said central section and said upper end to said support;

rotor means in said container for agitating said liquid and said media including a drive shaft extending through said container upper end and drive means mounted on said support connected to drive said shaft;

said container outlet section including a tubular filter screen vertically divided into a plurality of adjoining, unattached vertical screen segments, and a substantially solid, open-ended, tubular cover surrounding said screen and having means extending inwardly therefrom and abutting against said screen segments for maintaining the adjoinment of said screen segments, said cover being vertically divided into adjoining cover segments; and retaining means for (a) detachably mounting said cover segments to segments to said central section and said upper end, (b) maintaining the adjoinment of said cover segments to each other, and (c) maintaining the abutment of said inwardly extending means against said screen segments to permit said cover and screen to be removed without affecting the mounting of said container on said support.

22. An improved apparatus for grinding or processing a liquid, of the type having a vertical vessel for receiving grinding media and a liquid to be processed, a motor-driven rotor in said vessel for agitating said grinding media and said liquid, a liquid inlet at the bottom of said vessel, and a liquid outlet at the top of said vessel, wherein the improvement comprises:

a tubular filter screen coaxial with said rotor and proximate said outlet, said filter screen being axially divided into two adjoining arcuate screen segments;

a cover surrounding only the lower portion of said filter screen, said cover being axially divided into two adjoining arcuate cover segments which maintain the adjoinment of said screen segments; and retaining means for maintaining a sealing adjoinment between said cover segments.

23. An improved apparatus for grinding or processing a liquid, of the type having a vertical vessel for receiving grinding media and a liquid to be processed, a motor-driven rotor in said vessel for agitating said grinding media and said liquid, a liquid inlet at the bottom of said vessel, and a liquid outlet at the top of said vessel, wherein the improvement comprises:

a tubular filter screen coaxial with said rotor and proximate said outlet, said filter screen being axially divided into two adjoining arcuate screen segments;

a cover surrounding said filter screen, said cover being axially divided into two adjoining arcuate cover segments which maintain the adjoinment of said screen segments; and retaining means for maintaining a sealing adjoinment between said cover segments, said retaining means comprising a circular clamp surrounding said cover.

24. An apparatus for grinding or processing a liquid, comprising:

a support structure;

rotor means for agitating a grinding media and a liquid to be processed;

vertically oriented container means coaxial with said rotor means and attached to the side of said support structure for receiving said grinding media and said liquid to be processed, said container means having a lower inlet section, a central processing section having a flange around its upper periphery, and an upper outlet section detachably mounted to said processing section, said outlet section comprising:

a tubular filter screen vertically divided into two separable adjoining screen halves;

a cover surrounding said filter screen and vertically divided into two separable adjoining cover halves, the lower end of said cover having a flange adjoining said flange on said processing section; and retaining means, surrounding said adjoining cover flange and processing section flange, for detachably mounting said cover to said processing section and for maintaining the adjoinment of said screen halves and said cover halves, said filter screen halves and said cover halves being removable from each other and from said processing section by the removal of said retaining means.

25. The apparatus of claim 24 wherein said retaining means is a circular clamp.

* * * * *